US005236237A

United States Patent [19]

Shultz

[11] Patent Number: 5,236,237

[45] Date of Patent: Aug. 17, 1993

[54] DOG FECES COLLECTION DEVICE

[76] Inventor: Clair W. Shultz, 1830 Southwood Rd., Anderson, Ind. 46012

[21] Appl. No.: 871,001

[22] Filed: Apr. 20, 1992

[51] Int. Cl.[5] ..... A01K 29/00; E01H 1/12

[52] U.S. Cl. ..... 294/1.4; 15/104.8; 15/257.4; 294/53.5

[58] Field of Search ..... 294/1.3–1.5, 294/53.5, 55; 15/104.8, 257.1, 257.2, 257.4–257.8

[56] References Cited

U.S. PATENT DOCUMENTS

| | | | |
|---|---|---|---|
| 405,828 | 6/1889 | Card | 15/104.8 |
| 486,066 | 11/1892 | Abrams | 15/104.8 |
| 534,875 | 2/1895 | Gress | 15/257.7 |
| 805,904 | 11/1905 | Despain | 15/104.8 |
| 3,026,553 | 3/1962 | Whitmire | 15/104.8 |
| 3,052,214 | 9/1962 | Johnson | 15/257.6 X |
| 3,453,676 | 7/1969 | Meszaros | 15/104.8 |
| 3,827,098 | 8/1974 | Sanderson | 294/1.4 |
| 3,942,831 | 3/1976 | Sosnove | 294/1.4 |
| 4,005,892 | 2/1977 | Williams | 294/1.4 |
| 5,033,781 | 7/1991 | Flood | 294/1.4 |

FOREIGN PATENT DOCUMENTS

| | | | |
|---|---|---|---|
| 1067934 | 12/1979 | Canada | 294/1.4 |
| 373148 | 12/1963 | Switzerland | 15/257.2 |

*Primary Examiner*—Johnny D. Cherry
*Attorney, Agent, or Firm*—Robert A. Spray

[57] ABSTRACT

An open-ended container is carried on the end of a handle; and that connection is by a bail-wire, of a general U-shape, whose ends are rotatably mounted on the container side walls, the bail-wire's central or bight portion of the bail being rotatably connected to the handle by a pivotal connection which is also slidable. These features and their details provide that an easy swinging effort by the dog's owner will cause the container to swing to a reception condition in which the handle's scooper member is on the far side of the feces, and the container is in a position with its open end facing the feces. Then, by a pull upwardly on the handle, the feces is pushed toward and into the container; and then, merely by the owner's continuousness of the upward pull of the handle, the container swings to its carrying or at-rest condition, with its open end up, and with the feces safely carried in the bottom of the container. It is an easy and quick one-hand movement by the owner, with no danger of soiling his hands or shoes.

3 Claims, 4 Drawing Sheets

10
12
14
16
18
20
22
24
26
36
40
42
44
48

10
16
24
26
18
14
20
48
46
12
22
44
36

DOG FECES COLLECTION DEVICE

FIELD OF INVENTION AND ITS NEED

The present invention relates quite specifically to the long-lasting problem of the keeping of pet dogs, and of their keeping in urban areas, and even more particularly, the invention relates to the special and particular problem of dogs, quite in contrast to pet cats, is that many dogs seem not trainable to use a specific place at which they may be trained to eliminate their feces.

Even dogs which by nature or training are not objectionable by their other characteristics such as biting, barking, frightening humans, etc., the universal problem of dogs as pets is the universal problem of dogs eliminating their feces, which has been known and abhored worldwide, surely for scores of years.

The problem of dog feces is particularly objectionable when the dogs are kept in urban areas; and even if the dog owners very conscientiously keep the dogs on leashes when outside a building, and even if during the walk the owners succeed in getting the dogs' elimination of feces to occur in an adjacent area rather than on a sidewalk, there is still a problem of the feces being quite objectionable to neighbors, and others, even those who themselves like dogs as pets.

Although the device is useful to anyone who has the need to eliminate the disagreeable happening of dog feces, even persons who do not own the dog, the device is particularly useful on the occasions of the owner walking along with his or her dog on a short trip around the neighborhood; for on such a walking trip a dog may have not merely one happening of the dog's feces-elimination effort but another one or more such feces efforts during the trip.

The invention is particularly useful on that type of occasion, for the dog owner may use the apparatus more than once on any specific trip (of course depending upon factors of the need for this device, and the size of its receiving bucket); and this re-usability is quite advantageous, for it permits a pleasurable continuance of the walk without worrying about dropping an earlier-obtained feces, when the owner is attempting to achieve a pickup of subsequent feces encountered on the remainder of the walk.

Further advantage is provided of special convenience of the dog owner, for the concepts provide that the container will lie on the ground with its open end facing the feces for pickup of the feces, but also the concepts provide a nearly full automaticness of movement of the container to an "open end up" condition when the owner has retrieved the first feces encountered and raises the handle to begin a continuance of the owner's walk.

THE PRIOR ART HELPS SHOW PATENTABILITY HERE

In a hindsight consideration of the present invention to determine its inventive and novel nature, it is not only conceded but emphasized that the prior art had details usable in this invention but only if the prior art had the guidance of the present concepts of the present invention.

That is, it is emphasized that the prior art had/or knew several particulars which individually and accumulatively show the non-obviousness of this combination invention:

a. The prior art has long had mechanisms of various types which are used to pickup objects from the floor;

b. The prior art knew the advantages of pickup of all kinds of objects, and particularly pickup of messy or other disagreeable objects without touching the object with the person's hands;

c. The prior art has long had the problem of dog feces pickup;

d. The prior art has long known of the various "dust pans" for pickup use, even those having a long handle;

e. The prior art has realized the desire to rid the overall neighborhood of dog feces pickup and for acceptable disposal elsewhere.

In spite of all such factors of the prior art, the problem here solved awaited this inventor's creativity. More particularly, as to the novelty here of the invention as considered as a whole, a contrast to the prior art helps show its contrast to the present concepts, and emphasizes the advantages and the inventive significance of the present concepts as are here shown, and the nature of the concepts and their results can perhaps be easier understood.

However, dust pans having handles, and other prior art devices known to this inventor, which could possibly be adapted for this feces pickup duty, fail to show or suggest the details of the present concepts; and a realistic consideration of their several differences from the present concepts may more aptly be described as teaching away from the present invention's concepts, in contrast to suggesting them, even as to a hindsight attempt to perceive suggestions from a backward look into the prior art.

BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying drawings which are of somewhat schematic and diagrammatic nature, for showing the inventive concepts.

DETAILED DESCRIPTION OF THE ILLUSTRATIVE EMBODIMENT OF THE INVENTION

Figures 1, 2, 3:
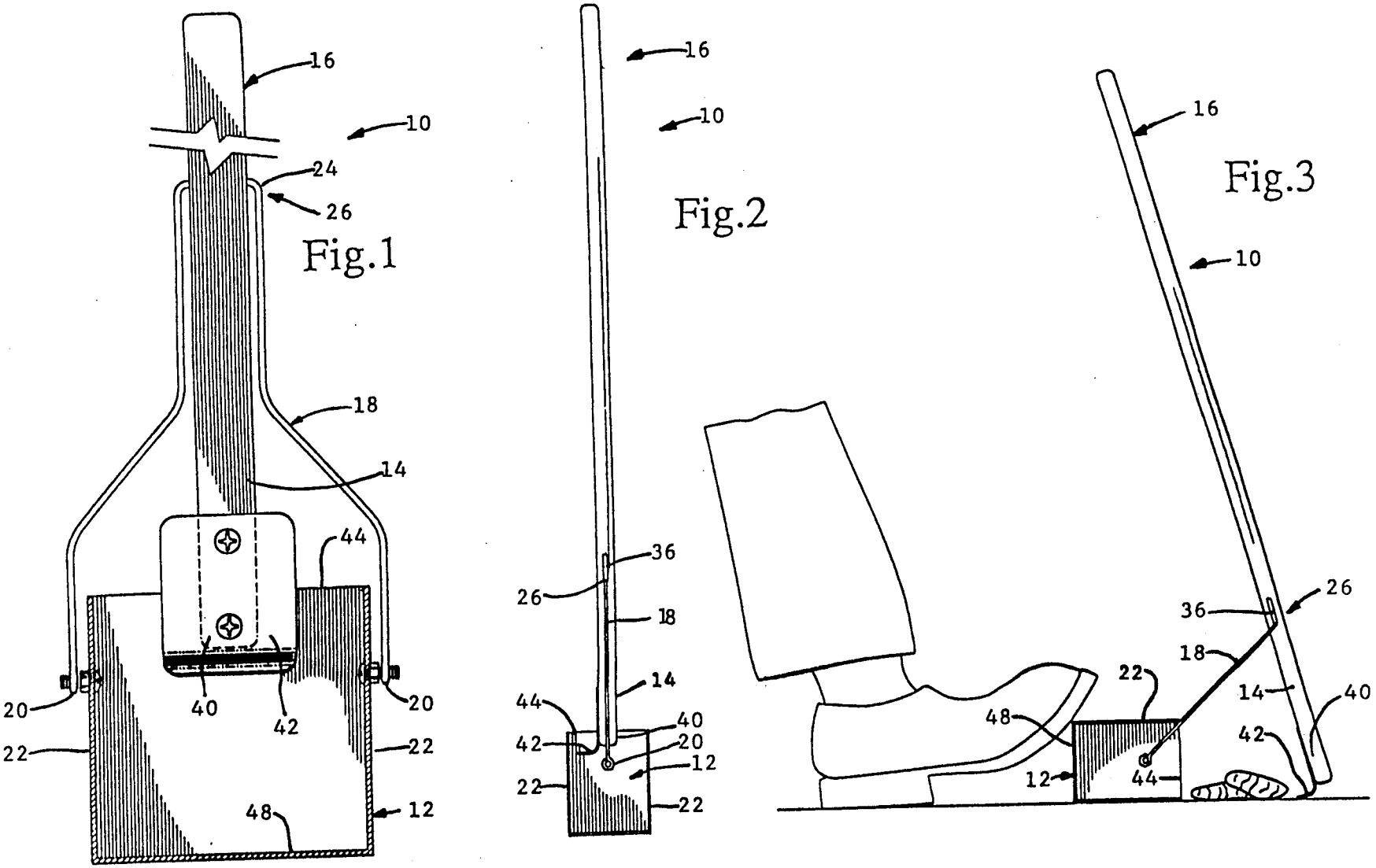
FIG. 1 is an elevation view of the feces collector box, the box being shown in a vertical cross-section, FIGS. 2–7, all on the same scale considerably smaller than the scale used in FIG. 1, are all vertical cross-sectional views through the collection box of the device, illustrating the device in sequential steps of use, with FIGS. 3–6 also showing the schematic indication of the user's foot and its use in the feces-collection procedure, more particularly.
FIG. 2 is a cross-sectional view through the collection-box, and showing, in side elevation view, the parts of the device in an upright position as the device would be carried by the user, both before (FIG. 2) and after (FIG. 7) the feces-collection procedure shown in other views.
FIG. 3 is a side elevation view of the device as it would appear after the initial step of swinging the handle such that the container has tipped over so that its open top faces the feces and the scooper body has been swung out so that it now faces the feces on the side opposite of that of the owner.
Figure 5:
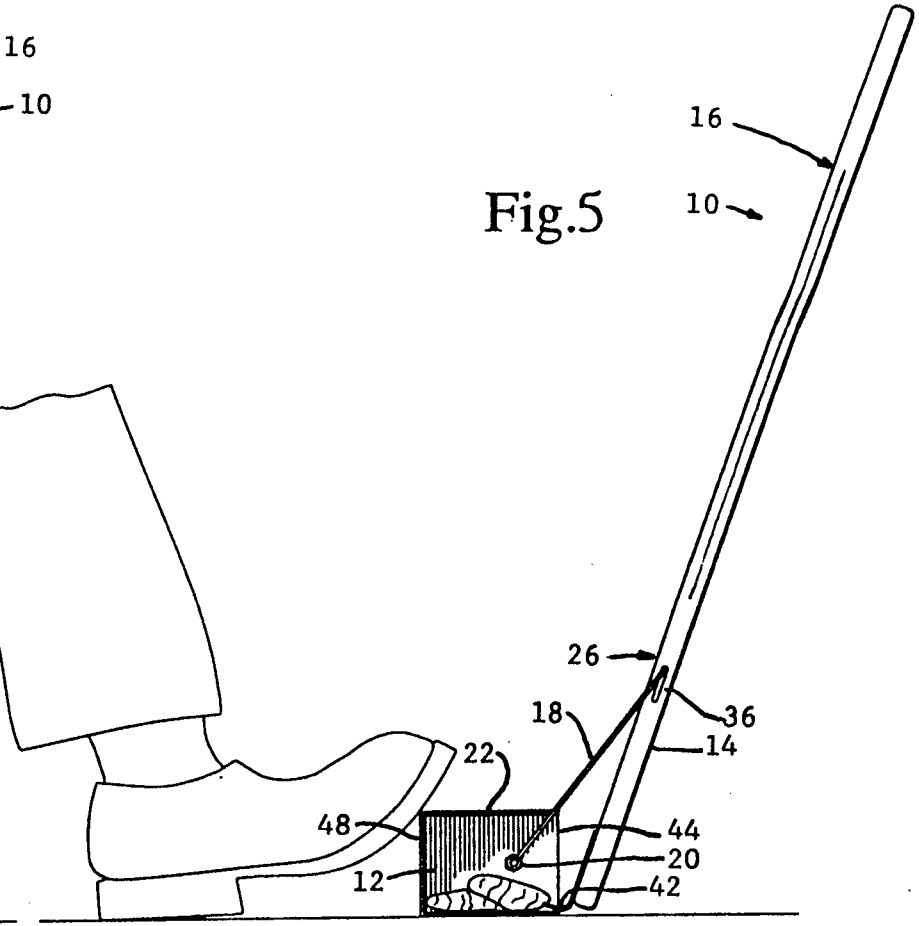
FIG. 5 shows the final step of the obtaining of the feces, as the feces has been pushed by the scooper body, the container still on its side, with the user's foot still holding the collection box.
Figure 4:
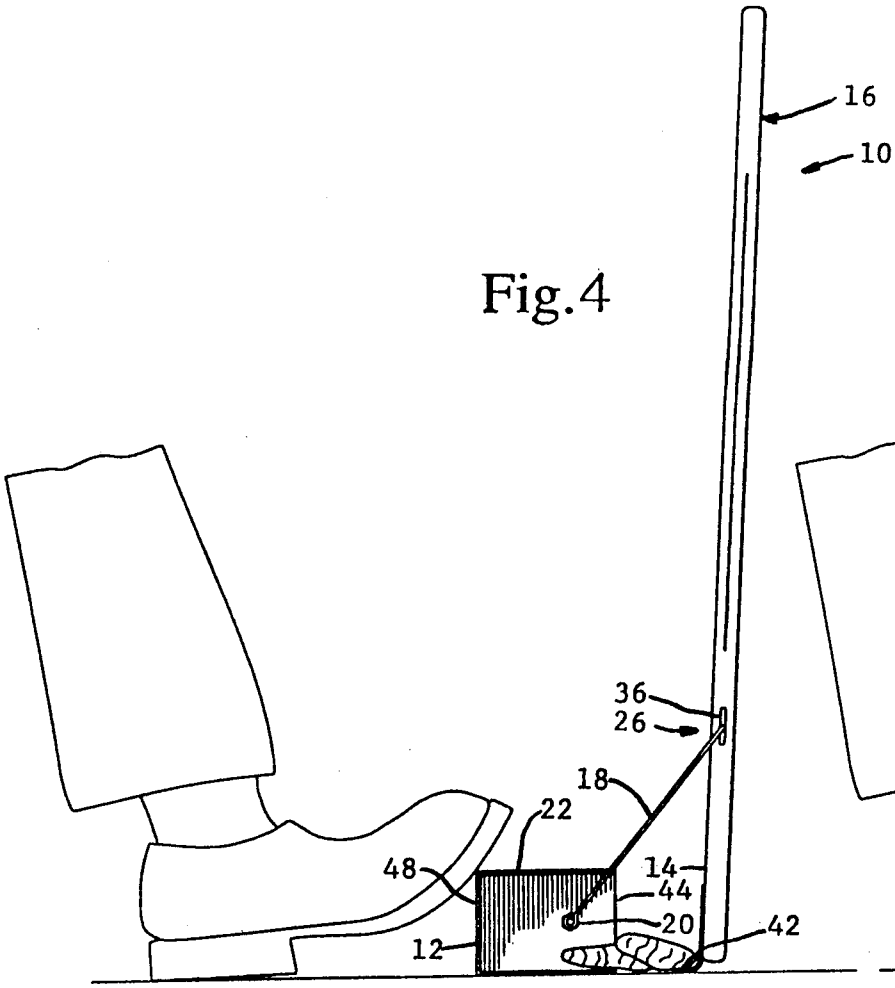
FIG. 4 shows the next step in the sequence, that is, in FIG. 4 the pushing of the feces into the container is about half finished, with the user's foot holding the collection box.
Figures 6, 7, 8, 9:
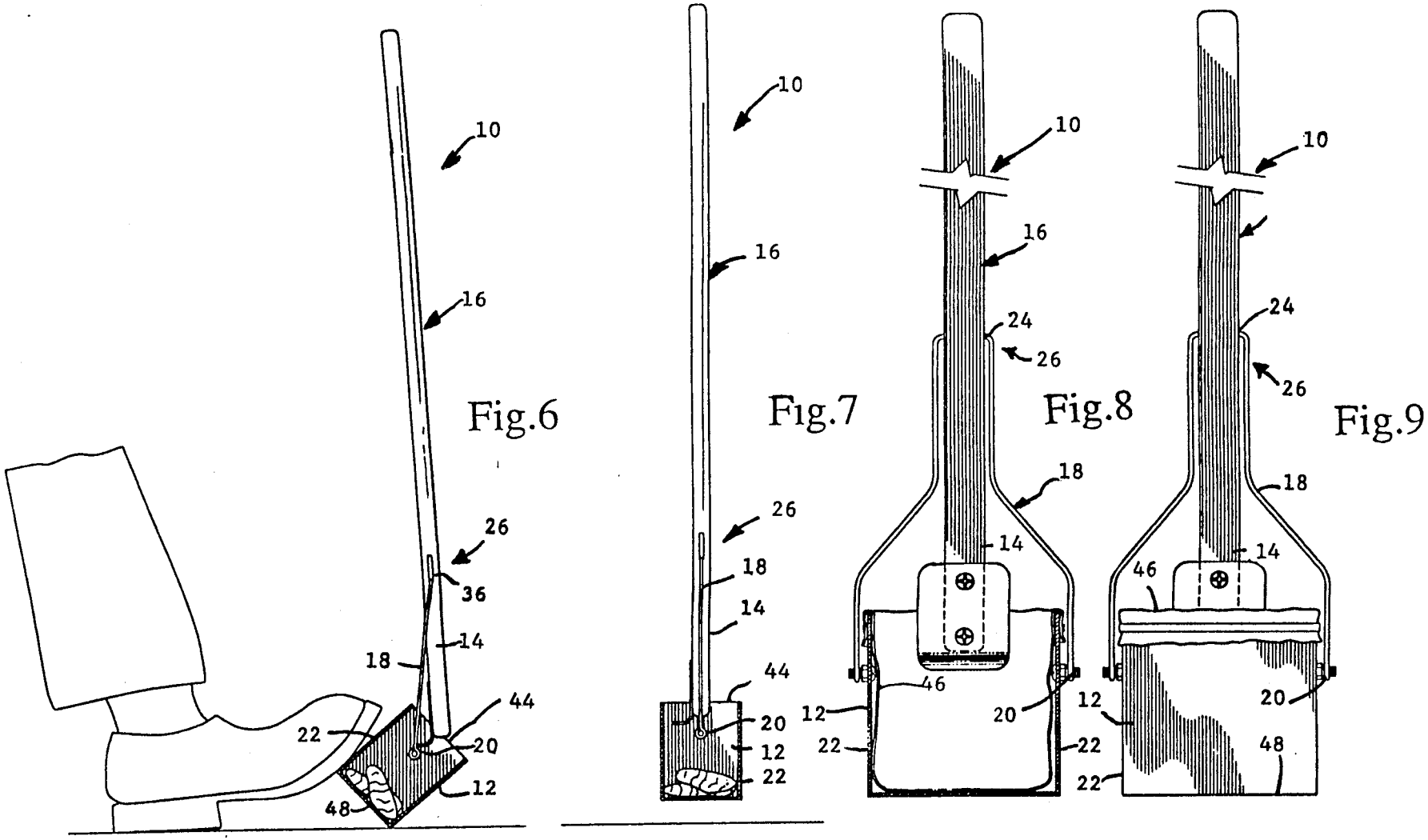
FIG. 6 now shows that the container is being pulled again to an upright condition by the bail-wire which is pivotedly mounted on the handle near its lower end, and with the user's foot still holding the collection box.
FIG. 7 shows the continuing effect of the user pulling upwardly on the handle, with the container upright and the feces safely nestled in the bottom of the container.
FIGS. 8 and 9, respectively, show the parts in vertical cross-section and in side elevation with a disposal bag held to the container for the user's convenience of disposal of the feces.

As the concepts are illustrated in the drawings, the apparatus provides a conveniently and easily used device 10, as a dog feces collection apparatus and procedure, very easy to use.

The device 10 is shown as a bucket or open-ended container 12 which as shown above carried on the lower end 14 of a handle 16.

Those parts, i.e., the bucket 12 and the handle 16 are probably the most visible parts; and they do somewhat resemble a dust pan having a handle. However, as explained herein, the other components which co-operate with the container bucket 12 and handle 16 provide a combination which is not even suggested by any sort of dust pan known to this inventor.

More particularly, the connection is by a link, here bail-wire 18 of a general U-shape, whose ends 20 are pivotably or rotatably mounted on the container side walls 22. The bail-wire's central or bight position 24 is rotatably connected to the handle 16 by a pivotal connection 26, which is also slidable for special effect as explained below.

Figure 10:
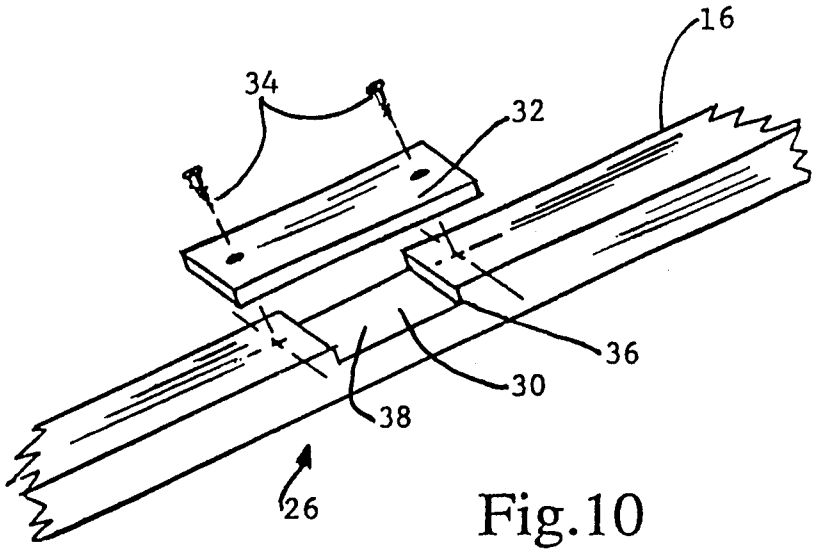
FIG. 10, in larger scale, illustrates the provision of an elongated receiver hole in the handle, which slidably receives the central or bight portion of the bail-wire, permitting that loose connection whose operativity is shown in the sequential views of FIGS. 2–3 and 6–9.

As illustrated best in FIG. 10, the pivotal connection 26 is shown merely by an axial recess 30 in the handle 16, with a short holder piece 32 held by screws 34; and the bight 24 of the bail 18 is passed transversely through the slot 36 formed between the holder 32 and the inner wall 38 of the recess 30. The slot 36 is schematically shown in the other FIGS. 2–7.

The handle 16 carries at its lower end 40 a scooper blade 42, shown by a small rectangular piece, one side of which is curved upwardly a small amount as illustrated.

Summarizing as to use, the owner flips the handle 16 in a way to swing the container 12 to a reception condition (FIG. 3) in which the handle's scoop member 42 is on the far side of the feces, and the container 12 is in a position with its open end 44 (FIG. 3) facing the feces as the feces is being pushed toward and into the container 12 which is in a tipped over position with its open end 44 (FIG. 3) facing the feces. Then the feces is pushed toward and into the container (FIG. 4), by the action of the owner stepping on the container 12 to hold it, and then pulling upwardly on the handle 16 which pulls the scoop blade 42 toward the feces and with the feces toward the container 12.

Then, as the owner simply continues his pull upwardly on the handle 16 (FIG. 5–6) the container 12 swings to its carrying or at-rest condition (FIG. 7) with its open end 44 up; and the owner and his dog have completed their respective tasks.

FURTHER OPERATIVITY AND CONCEPT DETAILS

The operativity and concept details in the text hereof, especially in view of the sequential views, are illustrations of basic concepts. However, other details and concepts, are shown as desirable components of this overall invention, including:

a. The various concepts provide a structure which can be of a very light weight, hardly a burden or bother to the owner.

b. It should be noticed that the bail-wire link's end 24 which is pivotally connected to the handle 16 at pivot 26 near the handle's bottom end 40, is spaced from the handle bottom 40 a distance such that the pickup bucket 12 has enough clearance that it may pass under the bottom 40 of the handle as they move with respect to one another during both the scooper-positioning step and the feces-collection step. This spacing is shown as about two times the height of the bucket 12.

c. Further, the bail-wire 18 is not the only type of link which would provide the operativity here; but desirably the link 18 is a bail-wire having a bight portion 24 which passes transversely through the handle 16 and is relatively movable with respect to the handle around the axis of the bight portion 24 of the bail-wire.

d. The axial slidability of the pivot 26 seems quite significant, for it seems to enable the owner to more assuredly keep a feces engaged by the scooper 42 during the pull-in step (FIG. 3 to FIG. 5) in which the portion of the handle which provides the pivotal connection with the link is provided to have a short axial recess 30 (FIG. 10) thereby providing an axial slidability so that the handle end 40 of the handle/scooper assembly may be moving relatively linearly along the ground, in contrast to moving along an arc having the pivot location as its center.

e. Also desirable, it will be noted that the distance between the bottom end 40 of the handle 16 and the pivotal connection 26 of the link 18 to the handle 16 at pivot 26 is provided to be about two to three times the height of the bucket.

f. Another desired component is that the bucket 12 is provided to have a discardable sack 46 as a replaceable liner.

g. Aiding the operability, the pivotal connection of the link 18 to the bucket 12 is such that the weight of the bucket portion between that connection (18 to 12) and the bucket end 48 opposite its open end 44 is greater than the weight of the bucket portion between that connection 18/12 and the bucket's open end 44.

CONCLUSION

It is thus seen that a litter-pickup device, as provided and used according to the inventive concepts herein set forth, provided novel concepts of a desirable and advantageous device, yielding the advantages of a conveniently and easily-used device for prompt and sanitary use, this device having advantageous details and features, which, in overall combination, are conceptually different from the prior art articles even though various objects embodying certain of the mechanical details as a basic capability have, or course, been known for years; yet significantly this particular combination, even considered as including a building on prior art concepts, has not been suggested by the prior art, this achievement being a substantial and advantageous departure from prior art, all this even though the prior art shows attempts at improvement and variations as to devices for easy and well-functioning use, making any lack of dog feces cleanup not only impolite and un-neighborly by a dog owner, but practically inexcusable.

And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention, and for a device whose function has been known as a need for scores of years. The need has been increasing as much of rural living has changed to city living for many dog owners.

SUMMARIZATION

Accordingly, it will thus be seen from the foregoing description of the invention according to that illustrative embodiment, considered with the accompanying drawings, that the present invention provides new and useful concepts in combination, which provide and achieve a novel and advantageous dog litter pickup device, yielding desired advantages and characteristics for this type device, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

I claim:

1. A dog feces collection device comprising, in combination:

a pickup bucket;

a pickup scooper;

a handle;

the handle having:

a top end portion, which provides grasping and holding means for manual manipulation of components as set forth below; and a bottom end, on which is carried the pickup scooper;

a movable link;

a link having:

a first link end, which is pivotally connected to a side wall of the bucket, and a second link end, which is pivotally connected to the handle near the handle's bottom end, but spaced therefrom a distance such that the pickup bucket has enough clearance that the bucket may pass under the bottom end of the handle as the second link end and the bucket move with respect to one another during both a scooper-positioning step and a feces collection step;

in a combination in which the link is a bail-wire having a bight portion which passes transversely through the handle and is relatively movable with respect to the handle around the axis of the bight portion of the bail-wire.

2. A dog feces collection device, as set forth in claim 1, in a combination in which the handle has a portion which provides that the pivotal connection of the handle with the link is provided to have a short axial recess, thereby providing an axial slidability of the link relative to the handle so that the end of the handle/scooper assembly may be moved relatively linearly along the ground.

3. A dog feces collection device, comprising, in combination:

a pickup bucket;

a pickup scooper;

a handle;

the handle having:

a top end portion, which provides grasping and holding means for manual manipulation of components as set forth below; and a bottom end, on which is carried the pickup scooper;

a movable link;

the link having:

a first link end, which is pivotally connected to a side wall of the bucket, and a second link end, which is pivotally connected to the handle near the handle's bottom end, but spaced therefrom a distance such that the pickup bucket has enough clearance that the bucket may pass under the bottom end of the handle as the second link end and the bucket move with respect to one another during both a scooper-positioning step and a feces collection step;

in a combination in which the handle has a portion which provides that the pivotal connection of the handle with the link is provided to have a short axial recess, thereby providing an axial slidability of the link relative to the handle so that the end of the handle/scooper assembly may be moved relatively linearly along the ground.

* * * * *